United States Patent [19]

Busse

[11] 4,420,867

[45] Dec. 20, 1983

[54] METHOD OF PRESSURE FITTING A TUBE IN A TUBE SHEET

[76] Inventor: Wilfried Busse, Harkortstrassee 8-10, 4630 Bochum 6, Fed. Rep. of Germany

[21] Appl. No.: 349,258

[22] Filed: Feb. 16, 1982

[30] Foreign Application Priority Data

Feb. 17, 1981 [DE] Fed. Rep. of Germany ..... 3105736

[51] Int. Cl.[3] ..... B23P 17/00; B21D 19/00; B21D 53/00

[52] U.S. Cl. ..... 29/421 R; 29/523; 29/157.4

[58] Field of Search ..... 29/157.4, 421 R, 523; 72/56, 58, 60, 61, 62

[56] References Cited

U.S. PATENT DOCUMENTS

| | | | |
|---|---|---|---|
| 3,977,068 | 8/1976 | Krips | 29/421 R |
| 4,125,937 | 11/1978 | Brown et al. | 72/62 |
| 4,210,991 | 7/1980 | Cooper | 72/58 |

FOREIGN PATENT DOCUMENTS

| | | |
|---|---|---|
| 1939105 | 6/1968 | Fed. Rep. of Germany . |
| 2400148 | 7/1975 | Fed. Rep. of Germany . |
| 2616523 | 11/1977 | Fed. Rep. of Germany . |

OTHER PUBLICATIONS

"Hydraulic Expansion of Tubes", VGB Kraftwerkstechnik, vol. 1, 1979, pp. 81-87, M. Podhorsky, H. Krips.

Hydraulic Tube Expansion, In Hes Maschinenbau.

*Primary Examiner*—Howard N. Goldberg

*Assistant Examiner*—Steven E. Nichols

*Attorney, Agent, or Firm*—Karl F. Ross; Herbert Dubno

[57] ABSTRACT

A tube end received in a bore of a tube sheet is expanded by introducing a mandrel into the tube end and utilizing fluid pressure to bias a pair of sealing rings outwardly to engagement with a tube end, thereby sealing off the clearance between the mandrel and the tube end. In addition to utilizing the fluid pressure to provide the sealing action, the invention admits the fluid pressure into the clearance and thereby expands the tube end.

5 Claims, 2 Drawing Figures

METHOD OF PRESSURE FITTING A TUBE IN A TUBE SHEET

CROSS-REFERENCE TO RELATED APPLICATION

This application is related to the currently filed copending application Ser. No. 349,259.

FIELD OF THE INVENTION

My present invention relates to the sealing of a tube in a plate and, more particularly, for the press fitting of a tube into a tube sheet or the like whereby the mechanical and fluid-tight connection of the tube and the plate is ensured.

BACKGROUND OF THE INVENTION

In boilers, heat exchangers, tube reactors, evaporators and condensers, so-called tube bundles are formed by groups of tubes and can terminate in tube bottoms or sheets which are plates. The plates may be secured in a housing which surrounds the tube bundle and can be traversed by the tubes providing both mechanical support and fluid-tight connection for the tubes.

It is known to form a fluid-tight press fit of a tube in a tube sheet or like plate, by inserting an end of the tube into a bore of the tube sheet with play or clearance and then expanding the tube end so that it bears uniformly against the wall of the bore for sealing and mechanical retention.

Mechanical expansion of the tube can be used for this purpose although, more recently, hydraulic expansion has become of greater interest.

In the hydraulic expansion technique a pressurizing mandrel is inserted into the tube end and the gap between the mandrel and the inner wall of the tube is sealed at two spaced-apart locations defining between them an expansion zone and a liquid is fed under high pressure into this zone to press the tube wall outwardly in the manner described.

Hydraulic expansion of the tubes is known from German patent document DE-OS No. 19 39 105 and in the article by M. Podhorsky and H. Krips entitled (in translation) "Hydraulic Expansion of Tubes" in VG Kraftswerktechnik, Number 1, 1979, pages 81–87.

The pressure-tight connection of tubes in tube sheets or the like, especially for heat exchanger tube bundles, represents a significant saving over earlier methods of securing such tubes and this has been recognized for several decades during which the mechanical expansion of tubes has been utilized.

However, even mechanical expansion is expensive and has the disadvantage that results are not always reproducible and it is not always possible to ensure that a particular tube attachment will correspond to a given standard. These problems are discussed in the Podhorsky et al article.

As noted by Podhorsky et al, hydraulic expansion has a number of advantages over the mechanical approach.

However, a practical problem arises with respect to the sealing of the opposite ends of the expansion zone in prior tube expansion techniques.

For example, as is described in German patent document DE-OS No. 19 39 105, the seals are generally applied after insertion of the mandrel by mechanical means, generally the use of compression cones which bear in the radial direction. This type of seal has the drawback that the setting of the seal by displacing at least one of the cones in the axial direction is time-consuming.

It is also a problem that at some applied pressure levels, the sealing effect may not be satisfactory.

In another hydraulic system described in German patent document DE-OS No. 24 00 148, the seal has a slightly larger diameter, before insertion of the mandrel in the tube end, than the inner diameter of the latter.

The insertion of the mandrel and the seal requires considerable axial force and effort and the sealing effect is not always satisfactory.

For example, since tolerance variations in the inner diameter and outer diameter of the tube ends and seals must be reckoned with, there are times when the maximum tolerance of the tube ends and the minimum tolerance of the seal may result in leakage and pressure loss.

Furthermore, because considerable axial force must be applied, damage to the seal may occur in the setting. Finally, since the seals can engage the inner wall of the tube tightly during insertion, trapped air, which cannot be vented, can be strongly compressed to impede insertion and pose problems with respect to the subsequent expansion.

OBJECTS OF THE INVENTION

It is the principal object of the present invention to provide an improved method of expanding tube ends in a tube sheet or like place whereby the aforementioned disadvantages are obviated and the expanding mandrel can be inserted easily and effortlessly while the sealing is nevertheless improved.

It is also an object of the invention to provide an improved method of operating a device for the pressure sealing of tube ends in a tube sheet.

Yet a further object of this invention is to provide an improved device for affixing a tube end in a tube sheet.

SUMMARY OF THE INVENTION

I have now discovered that the aforedescribed problems can be overcome by providing the expansion mandrel with a pair of axially spaced seals defining the expansion zone between them, and a passage opening into this zone for delivering fluid under pressure thereto.

According to the invention, the seals are constructed and arranged so as to enable them to be pressed against the inner wall of the tube end by the pressure fluid within the spreading mandrel.

More specifically, the invention provides that the fluid pressure, which will ultimately expand the tube end, is utilized to press the seals with radially outward force against the inner wall of the tube end.

Just as with the prior-art expansion mandrel, the mandrel of the present invention is inserted into a tube end which has been fitted into a tube sheet in the manner described, the mandrel being received with play in the tube end. Only after insertion of the mandrel in the tube end are the radial seals urged outwardly by the fluid pressure beyond the periphery of the mandrel and into engagement with the inner surface of the tube end.

Each seal can be an elastic element which normally is retracted by its intrinsic elasticity so that it does not project beyond the periphery of the mandrel until fluid pressure is applied (see the aforementioned copending application) whereupon the sealing ring is opened outwardly to engage the tube end with a force which is a function of the spreading pressure.

Note further that the degree of spread of the seal is only a function of the actual inner diameter of the particular tube end since the fluid expansion of the seal will also drive the latter outwardly until the seal engages the wall of the bias ends.

Problems with dimensional tolerances and the difficulties encountered with pressure cones and the like are eliminated.

Since initially and upon insertion of the mandrel into the tube end, the seals have diameters less than the inner diameter of the tube end to be anchored in the tube sheet, insertion of the mandrel is problem-free.

In accordance with the method of the present invention, the fluid may be fed to the mandrel initially at relatively low velocity such that the pressure is insufficient to expand the seal fully and to close off the expansion zone. During this period, the fluid drives out any air which might otherwise be trapped in the expansion zone. Since the flow rate is small during this period, the seals do not materially obstruct the flushing of air from the zone.

The liquid flow velocity is thereupon increased to the point that the pressure would outflow into this zone to cross the seal to be spread outwardly and block further flow from the zone. The pressure can then be increased to the spreading level.

The invention also includes a spreading mandrel which, according to the invention, can comprise a cylindrical body adapted to be received with clearance in a tube end to be spread. This body can be formed at two axially spaced locations with annular grooves, each of which receives an expandable sealing ring. A bore extending through the body forms a passage for the pressurized fluid, this passage communicating with the clearance between the seal and with each of the grooves so that the pressure of the fluid not only is transmitted to the clearance but also spreads the sealing ring outwardly. Preferably the outer diameter of the unexpanded ring is less than the outer diameter of the body of the mandrel.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
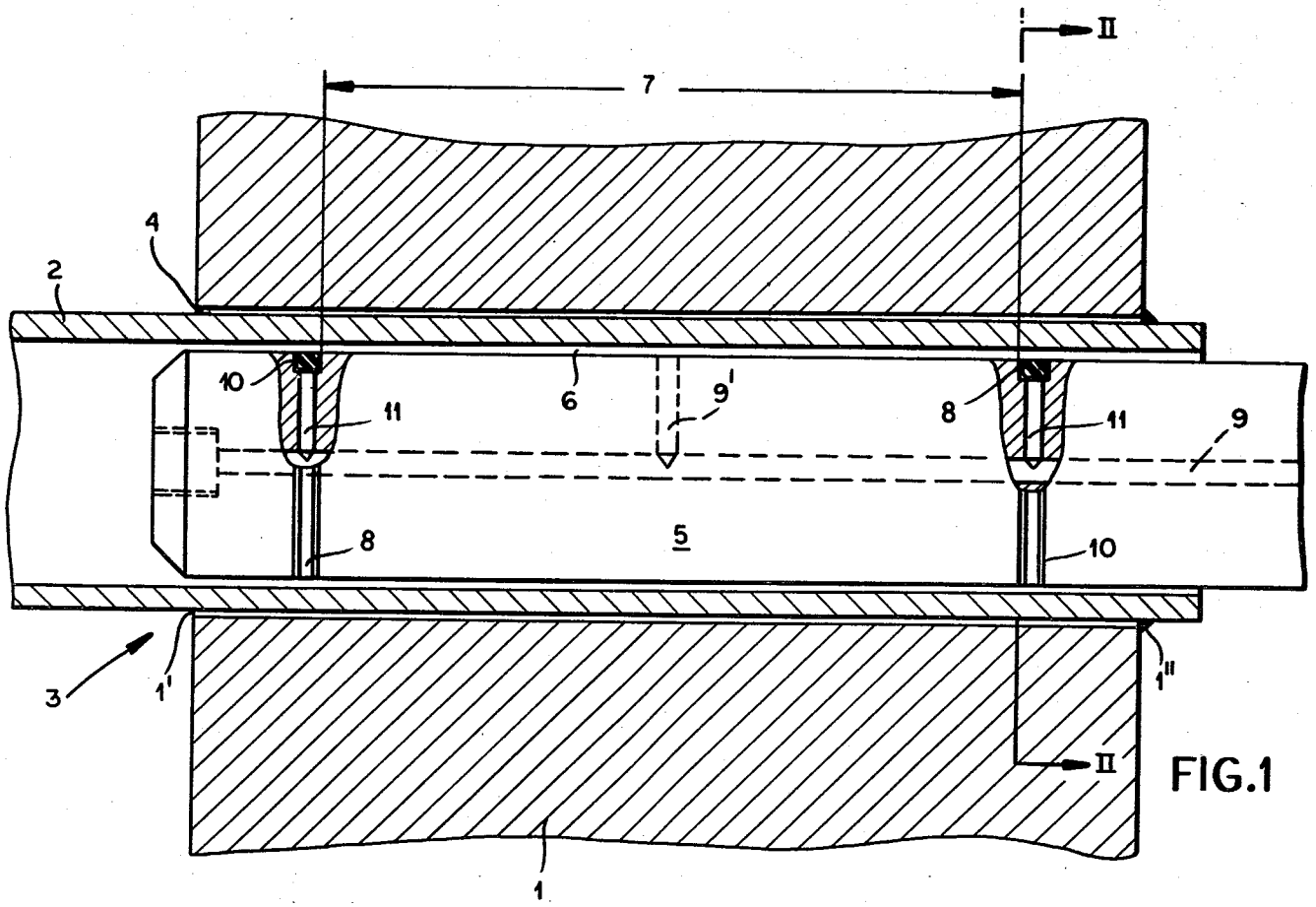
FIG. 1 is an axially cross-sectional view through a tube end and the portion of the tube sheet in which this tube end is to be anchored, showing the mandrel body in elevation but partly broken away.
Figure 2:
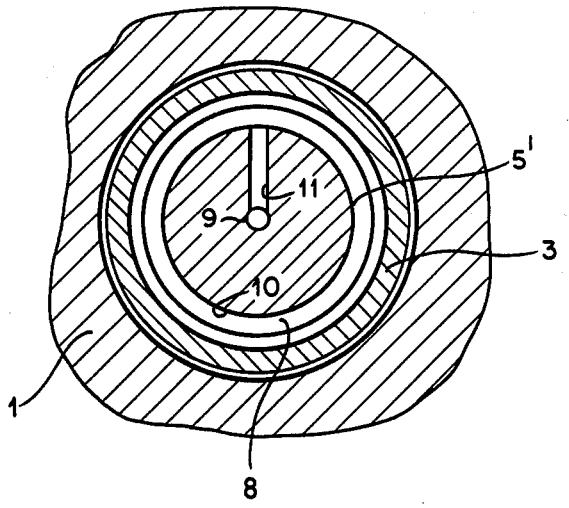
FIG. 2 is a section taken along the line II—II of FIG. 1.

In the drawing shown, a tube sheet 1 provided with a bore 1' into which an end 3 of a heat exchanger tube 2 is received with slight clearance 4 so that expansion of the tube end 3 will force-fit the tube 2 in this tube sheet.

Prior to expansion of the tube 1 which provides both mechanical attachment and a sealing engagement of the tube end in the sheet 1, the tube will be held in place by a deposit weld or solder fillet 1''.

An expansion mandrel 5 is introduced into the tube end 3 and has a body 5' whose outer diameter is less than the inner diameter of the tube end 3.

The clearance or space 6 between the tube end 3 and the mandrel 5 is sealed off at both ends of an expansion zone 7. For this purpose two seals 8 are provided in the form of elastic rings.

A central passage 9 is connected to a source of the pressurizing liquid (see the aforementioned application) and communicates with a radial passage 9' between the seals 8, i.e. within the zone 7.

Through the passages 9 and 9', the fluid can be introduced into the space 6 to radially drive the tube outwardly in the expansion process.

The seals 8 are received in circumferential grooves 10, each of which is connected by a radial bore 11 with the passage 9.

The outer diameters of the contracted seals 8 are less than the outer diameter of the mandrel body 5'.

The mandrel 5 is inserted into the tube end and the expansion liquid is forced at low velocity through the passage 9 so it floods the space 6 and drives out any air therein.

The flow velocity is then increased so that the back pressure at passage 11 is sufficient to drive the seals 8 outwardly and close off the space 6 so that further increases in pressure expand the tube hydraulically and bring about the mechanical and fluidtight seal as described.

I claim:

1. A method of force-fitting a tube end in a plate such as a tube sheet, comprising the steps of:

inserting a tube end in a bore formed in a plate;

introducing into said tube end within said bore, an expansion mandrel so that the mandrel is received with clearance within said tube end;

forcing a fluid under pressure through said mandrel and urging a pair of seals outwardly under fluid pressure into engagement with an inner wall of said tube end to seal said clearance between said seals of an expansion zone;

supplying said fluid through said mandrel to said zone at a pressure sufficient to expand said tube end and force-fit the same in said wall.

2. The method defined in claim 1 wherein said fluid is applied under pressure radially to said seal to expand the same.

3. The method defined in claim 1 or claim 2 wherein said pressure fluid is passed initially through said mandrel at a relatively low velocity so that said seals do not engage said wall whereby said pressure fluid drives trapped air from said zone, and thereafter with a higher velocity such that the pressure fit will expand said seals into engagement with said wall.

4. An expansion mandrel for expanding the tube end received in a bore formed in a tube sheet, said expansion mandrel comprising a cylindrical body formed with a passage adapted to communicate with a source of the fluid under pressure, said passage having an outlet along the periphery of said body, said body being formed with a pair of outwardly open circumferential grooves on opposite sides of said outlet and a respective seal received on each groove, each groove communicating with said passage whereby the pressure of said fluid displaces said seals outwardly to engage the wall of said tube end.

5. The mandrel defined in claim 4 wherein said seals have diameters less than the outer diameter of said body in contracted states of the seals.

* * * * *